United States Patent [19]

Ishida et al.

[11] Patent Number: 4,910,184

[45] Date of Patent: Mar. 20, 1990

[54] HEAT-SENSITIVE RECORDING MATERIALS

[75] Inventors: Katsuhiko Ishida, Takatsuki; Yoshihiro Shimizu, Amagasaki; Takashi Kawasaki, Kyoto; Yoshitaka Oeda, Ikoma, all of Japan

[73] Assignee: Kanzaki Paper Manufacturing Company, Ltd., Tokyo, Japan

[21] Appl. No.: 247,428

[22] Filed: Sep. 20, 1988

[30] Foreign Application Priority Data

Sep. 25, 1987 [JP] Japan ..... 62-241624
Jan. 26, 1988 [JP] Japan ..... 63-15510

[51] Int. Cl.[4] ..... B41M 5/18

[52] U.S. Cl. ..... 503/207; 427/152; 428/913; 428/914; 503/214; 503/226

[58] Field of Search ..... 427/152; 428/913, 914; 503/207, 214, 226

[56] References Cited

U.S. PATENT DOCUMENTS 4,686,546 8/1987 Koike et al. ..... 503/200

FOREIGN PATENT DOCUMENTS 54-92263 7/1979 Japan ..... 428/488.4
59-155097 9/1984 Japan ..... 428/488.4
1089883 5/1986 Japan ..... 503/200
61-193880 8/1986 Japan ..... 428/488.4
61-44683 3/1987 Japan ..... 428/488.4

*Primary Examiner*—Pamela R. Schwartz
*Attorney, Agent, or Firm*—Larson & Taylor

[57] ABSTRACT

Disclosed is a heat-sensitive recording material comprising a support and a heat-sensitive recording layer, characterized in that an intermediate layer is formed between the support and the heat-sensitive recording layer wherein the intermediate layer comprises a pigment having an apparent specific gravity of about 0.7 g/cm$^3$ or less and a polymeric substance having a glass transition temperature of 0° C. or lower as a binder.

16 Claims, No Drawings

HEAT-SENSITIVE RECORDING MATERIALS

This invention relates to heat-sensitive recording materials, and more particularly to heat-sensitive recording materials outstanding in dot reproducibility and excellent in cutting suitability and in folding suitability.

Heat-sensitive recording materials are well known which make use of the color forming reaction of a color forming material with a color developing material which develops a color on contact with the color forming material, such that the two materials are brought into contact with each other by heating to produce a color image. These heat-sensitive recording materials are relatively inexpensive, and recording devices for these materials are compact and relatively easy to maintain. Consequently such recording materials are useful as recording media for facsimile systems, computers, etc. and are also in wide use for other application.

With an increasing diversity of applications, there is a growing demand for heat-sensitive recording materials which exhibits an remarkable reproducibility of picture element (dot reproducibility) for record images of low to high color density and which can produce record images comparable in image quality to silver halide photography. The speedup of recording devices has also created a strong demand for heat-sensitive recording materials excellent in dynamic recording sensitivity.

To meet these demands, various methods have been proposed for preparing heat-sensitive recording materials capable of producing record images of high quality and having a high recording sensitivity. The proposed methods provide, for example, an intermediate layer of a film-forming polymeric substance with a glass transition temperature of 60° C. or lower formed between a support and a recording layer (Japanese Unexamined Patent Publication No. Sho 54-92263), an intermediate layer predominantly containing an oil-absorbing pigment formed between a support and a recording layer (Japanese Unexamined Patent Publications No. Sho 59-155097 and No. Sho 61-44683), and such layers superposed over each other for improving the surface smoothness and heat insulation properties (Japanese Unexamined Patent Publications Sho 61-11286 and Sho 61-193880).

However, the results given by these methods are not invariably satisfactory because of drawbacks newly derived from the improvements. For example, the method characterized by the intermediate layer of a film-forming polymeric substance provides a heat-sensitive recording material which has a dot reproducibility enhanced due to the improved surface smoothness but which is defective in that a increased amount of residual matter (which is formed from a binder, sensitizer and the like contained in the heat-sensitive recording layer in the course of recording) is piled up on thermal head and that the recording sensitivity is made unsatisfactory owing to the insufficient heat insulation properties presumably resulting from a low void ratio of the intermediate layer. The method characterized by the intermediate layer predominantly containing an oil-absorbing pigment produces a heat-sensitive recording material which is advantageous in being unlikely to allow the residual matter to pile on thermal head and in having a high recording sensitivity, but which has the disadvantages of tending to create paper dust when cut and to separate the recording layer when folded, presumably because of a low adhesion of the intermediate layer.

It is an object of the present invention to provide a heat-sensitive recording material which is free of said drawbacks of conventional heat-sensitive recording materials and which exhibits a remarkable dot reproducibility for record images of low to high color density and which produces record images of high quality.

It is another object of the invention to provide a heat-sensitive recording material which generates substantially no paper dust when cut (this property will be hereinafter referred to as "cutting suitability"), which causes substantially no separation of the recording layer when folded (this property will be hereinafter referred to as "folding suitability"), and which allows substantially no residual matter to pile on the thermal head.

The object of the invention can be achieved by the formation of an intermediate layer of a specific composition between a support and a recording layer.

The present invention provides a heat-sensitive recording material comprising a support and a heat-sensitive recording layer, the heat-sensitive recording material being characterized in that an intermediate layer is formed between the support and the recording layer, said intermediate layer comprising a pigment having an apparent specific gravity of about 0.7 g/cm$^3$ or less and a polymeric substance as a binder having a glass transition temperature of 0° C. or lower.

The heat-sensitive recording material of the invention can be prepared by applying to a support a coating composition comprising a pigment having an apparent specific gravity of about 0.7 g/cm$^3$ or less, preferably about 0.3 g/cm$^3$ or less and an emulsion or latex of a polymeric substance as a binder having a glass transition temperature of 0° C. or lower, preferably about −20° C. or lower, and drying the coating to form an intermediate layer on the support, coating the resulting intermediate layer with a coating composition for forming a heat-sensitive recording layer and drying the coating.

Useful pigments include various conventional inorganic or organic pigments. Preferred examples are calcined kaolin, talc, precipitated calcium carbonate, amorphous silica, polystyrene fine powder, urea-formalin resin fine powder and the like. Of these pigments, calcined kaolin and amorphous silica are superior in the effect of improving the recording sensitivity because they have high heat insulation properties and therefore the heat applied by a thermal head is effectively retained in the heat-sensitive recording layer.

The apparent specific gravity of said pigment is one as measured according to JIS K-6223. The lower limit of apparent specific gravity of useful pigments is not specifically limited, but is preferably about 0.1 gm$^3$. Consequently the apparent specific gravity of the pigment for use in the invention is preferably about 0.7 to about 0.1 g/cm$^3$, more preferably about 0.3 to about 0.1 g/cm$^3$. The particle size of the pigment is not specifically limited either and thus pigments of various particle sizes can be used in the invention. Yet good results are given by using a pigment having a mean particle size of about 0.1 to about 10 μm, preferably about 1 to about 4 μm.

According to the invention, a polymeric substance having a glass transition temperature of 0° C. or lower, preferably about −20° C. or lower, is incorporated as binder into the intermediate layer. Preferred examples of polymeric substances useful in the invention are natural rubber, polyisopene, polybutadiene and like polydienes, polyethylene, polybutene, polypropylene, polyisobutylene and like polyalkenes, and copolymers such as styrene-acrylic acid copolymer, styrene-butadiene copolymer, acrylonitrile-butadiene copolymer or the like. These copolymers may have carboxyl, hydroxyl or like functional group in the molecule. These binders are usually used in the form of an aqueous emulsion or latex. Among these, latices or emulsions of natural rubber, polyisoprenes or styrene-butadiene copolymers are preferred because such emulsions or latices, when applied and dried, form a film having an appropriate elasticity and adhesion and therefore produce the contemplated effects of the invention with good balance. More preferred are latices or emulsions of styrene-butadiene copolymers. The use of polymeric substance having a very low glass transition temperature as a binder tends to reduce the interlaminar strength and intermediate layer strength of the recording material and to impair the printing suitability. Thus it is generally preferable to use a polymeric substance having a glass transition temperature of about −90° C. or higher, more preferably about −70° C. or higher. Thus, according to the invention, the polymeric substances useful as a binder are those having a glass transition temperature of preferably about −90° to 0° C., more preferably about −70° to about −20° C. The solids concentration of the aqueous emulsion or latex of the polymeric substance is not specifically limited but preferably is in the range of about 20 to about 60% by weight, more preferably about 40 to about 55% by weight.

The specific pigment and the binder are contained as the main components in the intermediate layer preferably in a weight ratio of 100:5 to 100:40, more preferably 100:8 to 100:30, calculated as solids, in view of the adhesion and recording sensitivity. If the binder is used in a larger amount than in said ratio, it is often difficult for the recording material to show the desired recording sensitivity because the heat insulation properties are reduced presumably due to the decrease of void ratio of the intermediate layer, and a larger amount of residual matter tends to be piled up on thermal head. If the binder is used in a smaller amount than in said range, the pigment particles exhibit such reduced adhesion as to cause the likelihood that paper dust will be produced on cutting the recording material and that the recording layer will be separated on folding the same.

The specific intermediate layer can be formed on a support by first mixing together a pigment and an emulsion or latex of polymeric substance as a binder to obtain an aqueous coating composition and then applying the aqueous coating composition to the support, followed by drying. If desired, it is possible to incorporate into the coating composition an aqueous solution of a usual water-soluble polymeric substance such as polyvinyl alcohol, methyl cellulose, carboxymethyl cellulose, starch and/or an emulsion or latex of a polymeric substance having a high glass transition temperature of higher than 0° C., such as styrene-acrylic acid copolymer emulsion or acrylonitrile-butadiene copolymer emulsion, insofar as they do not adversely affect the contemplated effects of the invention. The water-soluble polymeric substance and/or emulsion or latex of polymeric substance having high glass transition temperature, when used, may be employed preferably in an amount of about 20 parts by weight or less per 100 parts by weight of the pigment, calculated as solids. Also auxiliaries to be described later with respect to a heat-sensitive recording layer may be added to a coating composition for forming the intermediate layer, if so desired. In any event, it is preferable that the coating composition for forming the intermediate layer has a solids concentration of about 10 to about 60% by weight.

The method for application of the coating compositions is not specifically limited, and can be carried out with use of a coater equipped with a suitable coating head such as an air-knife coater, gravure coater, roll coater, bar coater or the like.

According to the invention, while the intermediate layer may be of a single-layered structure, it is preferable that the intermediate layer has a multi-layered structure. Our research has revealed that the formation of multi-layered intermediate layer results in a rise of void ratio of the intermediate layer, and this leads to further increase in recording density. The reason therefor is not yet clarified but is presumably as follows. When the composition containing the foregoing pigment having a small apparent specific gravity and the emulsion or latex of polymeric substance having a low glass transition temperature as a binder is applied and dried so as to form two or more layers as superposed, the water and the binder present in the upper layer or layers effectively permeate into the pigment in the lower layer or layers, thereby causing a rise of void ratio of the upper layer or layers (i.e. the upper portion of the intermediate layer), consequently improving the retainability of the heat applied, and this in turn increases the recording density.

For this advantage, it is desirable to provide two or more layers as superposed for the formation of the intermediate layer of the heat-sensitive recording material according to the invention. The intermediate layer of such multi-layered structure of the invention may comprise about 5 layers at most in view of the surface strength of the intermediate layer and the increase in the number of steps for applying the coating composition. It is preferable that the multi-layered intermediate layer comprises 2 or 3 layers. In this case, the amount of the coating composition for forming such multi-layered intermediate layer is adjusted so that the resulting intermediate layer as a whole will have a thickness of about 8 to about 40 μm when dried and that each of the layers constituting the intermediate layer has a thickness of about 1 to about 20 μm when dried. When the intermediate layer has a single-layered structure, it is preferably about 5 to about 20 μm, more preferably about 8 to about 20 μm, in thickness when dried.

As described hereinbefore, the intermediate layer can be formed by various methods which are not specifically limitative. Yet our research has revealed that if at least one of the layers constituting the multi-layered intermediate layer is formed by a blade coating method, the resulting intermediate layer is given a smooth surface with high efficiency.

Therefore, when at least one of the layers constituting the multi-layered intermediate layer is formed by a blade coating method, there is no need for a calender treatment which is usually conducted under severe conditions to impart a surface smoothness, and thus smooth surface can be produced without involving any marked reduction of void ratio of intermediate layer which would otherwise be caused by severe calender treatment, with the result that the recording material so formed can produce record images of high quality and of high color density.

The heat-sensitive recording material of the invention is prepared by forming a heat-sensitive recording layer over the intermediate layer thus formed. The combinations of color forming materials and color developing materials to be incorporated in the heat-sensitive recording layer according to this invention are not specifically limited, and can be any of those which can cause a color forming reaction upon contact of the two materials by heating. Useful examples are the combination of a colorless or pale-colored basic dye and an inorganic or organic acidic material, and the combination of ferric stearate or like metallic salt of higher fatty acid and gallic acid or like phenol. Further usable in this invention are the combinations of a diazonium compound, a coupler and a basic substance which can form a color by application of heat. The heat-sensitive recording materials of this invention include those comprising various combinations of these materials.

The intermediate layer of this invention formed on a support according to the invention is most preferably used when the heat-sensitive recording layer contains a colorless or pale-colored basic dye and an inorganic or organic acidic material.

Examples of useful colorless or pale-colored basic dyes are those already known and include:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenylspiro-dinaphthopyran, 3-benzyl-spiro-dinaphthopyran, 3-methyl-naphtho-(6'-methoxybenzo)spiropyran, 3-propylspiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, -diethylamino-7-chlorofluoran, 3-diethylamino-6-methyl-7-chlorofluoran, 3-diethylamino-6,7-dimethylfluoran, 3-(N-ethyl-p-toluidino)7-methylfluoran, 3-diethylamino-7-(N-acetyl-N-methylmmino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-cyclopentyl-N-ethylamino)-6-methyl-7-anilinofluoran, 3-(N-ethyl-p-toluidino)-6-methyl-7-(p-toluidino)fluoran, 3-3-diethylamino-6-methyl-7-phenylamino-flouran, 3-diethylamino-7-(2-carbomethoxy-phenylamino)fluoran, 3-(N-ethyl-N-isoamylamino)-6-methyl-7-phenylaminofluoran, 3-(N-cyclohexyl-N-methylamino)-6-methyl-7-phenylamino-fluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-tetrahydrofurfurylamino)-6-methyl-7-anilinofluoran, 3-(N-ethyl-N-tetrahydrofurfurylamino)-6-methyl-7-anilinofluoran.

Examples of inorganic or organic acidic materials which undergo a color forming reaction with such basic dyes on contact therewith are those already known, such as inorganic acidic materials including activated clay, acidic clay, attapulgite, bentonite, colloidal silica and aluminum silicate; and organic acidic materials including phenolic compounds such as 4-tert-butylphenol, 4-phenoxyphenol, $\alpha$-naphthol, $\beta$-naphthol, 4-hydroxyacetophenone, 4-tert-octylcatechol, 2,2'-dihydroxydiphenyl, 2,2'-methylenebis(4-methyl-6-tert-butylphenol), 4,4'-isopropylidenebis(2-tert-butylphenol), 4,4'-secbutylidenediphenol, 4-phenylphenol, 4,4'-isopropylidenediphenol(bis-phenol A), 4-hydroxy-4'-isopropoxydiphenylsulfone, 4,4'-(1,3-dimethylbutylidene)bisphenol, 2,2'-methylenebis(4-chlorophenol), hydroquinone, 4,4'-cyclohexylidenediphenol, 4-hydroxybenzoic acid benzyl ester, 4-hydroxyphthalic acid dimethyl ester, hydroquinone monobenzyl ether, novolak phenol resins and phenolic polymers; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropysalicylic acid, 3-tert-butylsalicylic acid, 3-benzylsalicylic acid, 3-($\alpha$-methylbenzyl)-salicylic acid, 3-chloro-5-($\alpha$-methylbenzyl)-salicylic acid, 3,5-di-tert-butylsalicylic acid, 3-phenyl-5-($\alpha$,$\alpha$-dimethylbenzyl)-salicylic acid and 3,5-di-($\alpha$-methylbenzyl)-salicylic acid; also, salts of such phenolic compounds or aromatic carboxylic acids with polyvalent metals such as zinc, magnesium, aluminum, calcium, titanium, manganese, tin and nickel.

For the preparation of the heat-sensitive recording material of the present invention, the proportions of the color forming material and the color developing material to be incorporated into the recording layer are suitably determined according to the kinds of these materials and are not particularly limited. For example, when the combination of a colorless or pale-colored basic dye and an inorganic or organic acidic material is used, about 1 to about 50 parts by weight, preferably about 1 to about 10 parts by weight, of the acidic material is used per part by weight of the basic dye.

These materials are formulated into a heat-sensitive coating composition generally with use of water as a dispersion medium and with use of a stirring or pulverizing device, such as a ball mill, attritor or sand mill, by dispersing the two materials at the same time or separately.

Usually the coating composition has incorporated therein a binder, such as starches, hydroxyethyl cellulose, methyl cellulose, carboxymethyl cellulose, gelatin, casein, gum arabic, polyvinyl alcohol, diisobutylene-maleic anhydride copolymer salt, styrene-maleic anhydride copolymer salt, ethylene-acrylic acid copolymer salt, styrene-acrylic acid copolymer-salt, natural rubber emulsion, styrene-butadiene copolymer emulsion, acrylonitrile-butadiene copolymer emulsion, methyl methacrylate-butadiene copolymer emulsion, polychloroprene emulsion, polyvinyl acetate emulsion, ethylene-vinyl acetate emulsion or the like. The binder is used in an amount of about 5 to about 70% by weight, preferably about 10 to about 50% by weight, based on the total solids content of the composition for heat-sensitive recording layer.

Various auxiliary agents can be further admixed with the heat-sensitive coating composition. Examples of useful auxiliary agents are dispersants such as sodium diocytylsulfosuccinate, sodium dodecylbenzenesulfonate, sodium lauryl sulfate, alginate and fatty acid metal salts; ultraviolet absorbers of the benzophenone, triazole or like type; defoaming agents, fluorescent dyes; coloring dyes, etc.

Further when desired, other additives can be incorporated into the composition. Examples of useful additives are waxes such as zinc stearate, calcium stearate, polyethylene wax, carnauba wax, paraffin wax and ester wax; inorganic pigments such as calcium carbonate, zinc oxide, aluminum oxide, titanium dioxide, silica, aluminum hydroxide, barium sulfate, zinc sulfate, talc, kaolin, clay, calcined clay and colloidal silica; organic pigments such as styrene microball, nylon powder polyethylene powder, urea-formalin resin filler and raw starch; heat-fusible materials such as fatty acid amides, e.g., stearic acid amide, stearic acid methylenebisamide, oleic acid amide, palmitic acid amide, and coconut fatty acid amide; dibenzyl terephthalate, 1,2-di(3-methylphenoxy)ethane, 1,2-diphenoxyethane, 4,4'-ethylenedioxybis-benzoic acid diphenylmethyl ester; and hindered phenols, e.g., 1,1,3-tris(2-methyl-4-hydroxy-5-tertbutylphenyl)butane, 2,2'-methylenebis(4-methyl-6-tertbutylphenol), 4,4'-butylidenebis(6-tert-butyl-3-methylphenol), and the like. When the heat-sensitive coating composition contains the inorganic or organic pigment, it is preferable to use a pigment having a small particle size, in particular a pigment having an average particle size of 2 μm or less.

The method of forming the recording layer of the heat-sensitive recording material of the invention is not particularly limited but can be any of conventional methods. For example, the heat-sensitive coating composition is applied to the intermediate layer by means of a coating device comprising a suitable coater head such as air knife coater or blade coater and then dried. The amount of the coating composition, which is also not particularly limited, is generally about 2 to about 12 g/m$^2$, preferably about 3 to about 10 g/m$^2$, based on dry weight.

The support or base sheet is not particularly limited and includes papers such as wood-free paper, basic paper prepared by Yankee machine, machine-glazed paper, both-face calendered basic paper, cast-coated paper, no.1 grade coated paper, coated paper, light weight coated paper, or the like; synthetic fiber papers; synthetic films and the like.

When required, smoothing treatment such as super calendering may be effected after application and drying of the intermediate layer and heat-sensitive recording layer. Various other means conventionally known in the art can also be adopted. For example, an overcoat layer may be formed on the recording layer for the protecting thereof. A rear side layer may be formed on the rear side of the base sheet.

Due to the presence of the intermediate layer having the specific composition between the support and heat-sensitive recording layer, the heat-sensitive recording layer of the invention is excellent in picture element reproducibility (dot reproducibility) irrespective of whether the image density is high or low, and furthermore has outstanding cutting suitability and folding suitability and prevents or suppress the piling of residual matter on thermal head.

The reason why such excellent effects can be achieved by the present invention still remains to be clarified, but it is presumed that such excellent effects are produced because a smooth intermediate layer having high heat-insulating property and elasticity is formed over the support by the use of the pigment having a low apparent specific gravity and the latex or emulsion of a polymeric substance having low glass transition temperature. Especially, it is presumed that the latex or emulsion of a polymeric substance having the above-specified low glass transition temperature, when applied and dried, quickly forms film, thereby imparting rubber-like elasticity and strength to the intermediate layer, and the use of such polymeric substance having low glass transition temperature in combination with the pigment of low apparent specific gravity synergistically produces the foregoing excellent effects.

The present invention will be describe below in greater detail with reference to examples, to which the invention of course is in no way limited, and with reference to comparative examples. In these examples and comparative examples, the parts and the percentages are all by weight unless otherwise specified.

EXAMPLE 1

Formation of Intermediate Layer:

| | |
|---|---|
| Calicined kaolin (tradename "ANSILEX", product of Engelhard, apparent specific gravity: 0.22 g/cm$^3$) | 100 parts |
| Natural rubber latex (tradename "Dy-5", product of Guthrie, glass transition temperature (Tg) of natural rubber: −60° C., solids content: 60%) | 20 parts |
| 10% Aqueous solution of polyvinyl alcohol | 15 parts |
| Water | 100 parts |

The above components are mixed homogeneously to prepare a coating composition for intermediate layer. The coating composition obtained was applied to a wood-free paper weighing 50 g/m$^2$ in an amount of 10 g/m$^2$ (thickness: 12 μm) on dry basis and then dried to provide an intermediate layer.

Formation of Heat-Sensitive Recording Layer:

| (1) Preparation of Mixture A | |
|---|---|
| 3-(N-Cyclohexyl-N-methylamino)-6 methyl-7-phenylaminofluoran | 10 parts |
| Dibenzylterephthalate | 20 parts |
| 5% Aqueous solution of methyl cellulose | 15 parts |
| Water | 80 parts |

The above mixture was pulverized by a sand mill to an average particle size of 3 μm.

| (2) Preparation of Mixture B | |
|---|---|
| 4,4'-Isopropylidenediphenol | 30 parts |
| 5% Aqueous solution of methyl cellulose | 30 parts |
| Water | 70 parts |

The above mixture was pulverized by a sand mill to an average particle size of 3 μm.

A recording layer coating composition was prepared by mixing 125 parts of Mixture A, 130 parts of Mixture B, 30 parts of silicon oxide pigment (oil absorption: 180 ml/100 g), 150 parts of 20% aqueous solution of oxidized starch and 55 parts of water with stirring.

The coating composition obtained was applied to the above intermediate layer in an amount of 5 g/m$^2$ on dry basis to provide a heat-sensitive recording paper.

EXAMPLE 2

To the intermediate layer as provided in Example 1 was further applied the same coating composition for intermediate layer in an amount of 5 g/m$^2$ (thickness: 7 μm) on dry basis to provide an intermediate layer having a double-layered structure.

The recording layer coating composition as used in Example 1 was applied to this double-layered intermediate layer and dried in the same manner as in Example 1 to obtain a heat-sensitive recording paper.

EXAMPLE 3

Formation of Intermediate Layer:

| | |
|---|---|
| Amorphous silica (tradename: Mizukasil P-527, product of Mizusawa Kagaku Kabushiki Kaisha, apparent specific gravity of 0.18 g/cm$^3$) | 100 parts |
| Styrene-butadiene copolymer latex (Tg of styrene-butadiene copolymer: −35° C., solids content: 45%) | 25 parts |
| 10% Aqueous solution of polyvinyl alcohol | 15 parts |
| Water | 100 parts |

The above components were mixed together to prepare an intermediate layer coating composition. The coating composition obtained was applied to a wood-free paper weighing 50 g/m$^2$ in an amount of 10 g/m$^2$ (thickness: 12 μm) on dry basis and dried to provide an intermediate layer.

To this intermediate layer was applied the recording layer coating composition as used in Example 1 and dried in the same manner as in Example 1, giving a heat-sensitive recording paper.

EXAMPLE 4

(a) A heat-sensitive recording paper was prepared in the same manner as in Example 1 with the exception of using 20 parts of styrene-butadiene copolymer latex (Tg of styrene-butadinene copolymer: −60° C., solids content: 60%) in place of 20 parts of natural rubber latex used for forming the intermediate layer.

(b) A heat-sensitive recording paper was prepared in the same manner as in Example 1 with the exception of using 20 parts of styrene-butadiene copolymer latex (Tg of styrene-butadiene copolymer: −25° C., solids content: 60%) in place of 20 parts of natural rubber latex used for forming the intermediate layer.

EXAMPLE 5

A heat-sensitive recording paper was prepared in the same manner as in Example 3 with the exception of using 25 parts of styrene-acrylic acid latex (Tg of styrene-acrylic acid copolymer: −35° C., solids content: 45 %) in place of 25 parts of styrene-butadiene copolymer latex used for forming the intermediate layer.

EXAMPLE 6

An intermediate layer was provided in the same manner as in Example 3. To this intermediate layer was applied the intermediate layer coating composition as used in Example 4(*a*) in an amount of 10 g/m$^2$ (thickness: 12 μm) on dry basis and then dried. The recording layer coating composition was applied to this intermediate layer having a double-layered structure and dried in the same manner as in Example 1 to prepare a heat-sensitive recording paper.

EXAMPLE 7

A heat-sensitive recording paper was prepared in the same manner as in Example 4(*a*) except that the intermediate layer coating composition was applied in an amount of 4 g/m$^2$ thickness: 5 μm) on dry basis instead of 10 g/m$^2$ (thickness: 12 μm) on dry basis.

EXAMPLE 8

A heat-sensitive recording paper was prepared in the same manner as in Example 3 except that styrene-butadiene copolymer latex was used in an amount of 100 parts instead of 25 parts.

EXAMPLE 9

A heat-sensitive recording paper was prepared in the same manner as in Example 4(a) except that styrene-butadiene copolymer latex was used in an amount of 5 parts instead of 20 parts.

EXAMPLE 10

A heat-sensitive recording paper was prepared in the same manner as in Example 4(*a*) with the exception of using styrene-butadiene copolymer latex (Tg of styrene-butadiene copolymer: −5° C., solids content: 60%) in place of the latex of styrene-butadiene copolymer having a glass transition temperature of −60 ° C.

EXAMPLE 11

Preparation of Intermediate Layer Coating Composition-I:

| | |
|---|---|
| Calcined kaolin (tradename: ANSILEX, product of Engelhard, apparent specific gravity: 0.22 g/cm$^3$) | 100 parts |
| Styrene-butadiene copolymer latex (Tg of styrene-butadiene copolymer: −20° C., solids content: 50%) | 20 parts |
| 10% Aqueous solution of polyvinyl alcohol | 15 parts |
| Water | 100 parts |

The above components were mixed together to prepare intermediate layer coating composition-I Formation of Intermediate Layer:

Intermediate layer coating composition-I was applied to a wood-free paper weighing 50 g/m$^2$ in an amount of 8 g/m$^2$ (thickness: 10 μm) on dry basis using an air knife coater and dreed. Thereto was further applied the same coating composition in an amount of 5 g/m$^2$ (thickness: 7 μm) on dry basis using a blade coater and dried to provide a double-layered intermediate layer.

Preparation of Recording Layer Coating Composition:

| (1) Preparation of Mixture A | |
|---|---|
| 3-(N-Cyclohexyl-N-methylamino)-6-methyl-7-phenyaminofluoran | 10 parts |
| Dibenzylterephthalate | 20 parts |
| 5% Aqueous solution of methyl cellulose | 15 parts |

-continued

| (1) Preparation of Mixture A | |
|---|---|
| Water | 80 parts |

The above mixture was pulverized by a sand mill to an average particle size of 3 μm.

| (2) Preparation of Mixture B | |
|---|---|
| 4,4'-Isopropylidenediphenol | 30 parts |
| 5% Aqueous solution of methyl cellulose | 30 parts |
| Water | 70 parts |

The above mixture was pulverized by a sand mill to an average particle size of 3 μm.

A 125 parts quantity of Mixture A, 130 parts of Mixture B, 30 parts of silicon oxide pigment (oil absorption: 180 ml/100 g), 150 parts of 20% aqueous solution of oxidized starch and 55 parts of water were mixed together and agitated to prepare a heat-sensitive recording layer coating composition.

Formation of Heat-Sensitive Recording Layer:

The recording layer composition was applied to the above intermediate layer in an amount of 5 g/m$^2$ on dry basis using an air knife coated and then dried to give a heat-sensitive recording paper.

EXAMPLE 12

To the double-layered intermediate layer as obtained in Example 11 was further applied intermediate layer coating composition-I in an amount of 5 g/m$^2$ (thickness: 7 μm) on dry basis using an air knife coater and dried to provide an intermediate layer having a triple-layered structure.

The recording layer coating composition as used in Example 11 was applied to this intermediate layer and dried in the same manner as in Example 11 to prepare a heat-sensitive recording paper.

EXAMPLE 13

Preparation of Intermediate Layer Coating Composition-II:

| | |
|---|---|
| Amorphous silica (tradename: Mizukasil P-527, product of Mizusawa Kagaku Kabushiki Kaisha, apparent specific gravity: 0.18 g/cm$^3$) | 100 parts |
| Polyisoprene latex (tradename: LIR-700, product of Kuraray, Tg of polyisoprene: −50° C., solids content: 45%) | 25 parts |
| 10% Aqueous solution of polyvinyl alcohol | 15 parts |
| Water | 100 parts |

The above components were mixed together to prepare intermediate layer coating composition-II.

Formation of Intermediate Layer:

Intermediate layer coating composition-II was applied to a wood-free paper weighing 50 g/m$^2$ in an amount of 10 g/m$^2$ (thickness: 12 μm) on dry basis using an air knife coater and dried. Thereto was applied intermediate coating composition-I with a rod blade coater in an amount of 5 g/m$^2$ (thickness: 7 μm) on dry basis and then dried to provide an intermediate layer.

Formation of Heat-Sensitive Recording Layer:

A heat-sensitive recording paper was prepared by applying the recording layer coating composition as used in Example 11 to this intermediate layer and drying in the same manner as in Example 11.

EXAMPLE 14

A heat-sensitive recording paper was prepared in the same manner as in Example 11 with the exception of using a latex of styrene-butadiene copolymer with Tg of −10° C. (solids content: 50%) in place of the latex of styrene-butadiene copolymer with Tg of −20° C.

COMPARARTIVE EXAMPLE 1

| Formation of intermediate layer: | |
|---|---|
| Calcined kaolin (tradename: "ANSILEX", product of Engelhard, apparent specific gravity: 0.22 g/cm$^3$) | 100 parts |
| Styrene-butadiene copolymer latex (Tg of styrene-butadiene coolymer: +5° C., solids content: 48%) | 25 parts |
| 10% Aqueous solution of polyvinyl alcohol | 15 parts |
| Water | 100 parts |

The above components were mixed together to prepare an intermediate layer coating composition. The coating composition was applied to a wood-free paper weighing 50 g/m$^2$ in an amount of 10 g/m$^2$ (thickness: 12 μm) on dry basis to provide an intermediate layer.

To this intermediate layer was applied the recording layer coating composition as used in Example 1 and dried in the same manner as in Example 1 to prepare a heat-sensitive recording paper.

COMPARATIVE EXAMPLE 2

A heat-sensitive recording paper was prepared in the same manner as in Example 1 with the exception of using styrene-butadiene copolymer latex (Tg of styrene-butadiene copolymer: +20° C., solids content: 60%) in place of the natural rubber latex used for the formation of intermediate layer.

COMPARATIVE EXAMPLE 3

A heat-sensitive recording paper was prepared in the same manner as in Example 1 with the exception of using kaolin (tradename: UW-90, product of Engelhard, apparent specific gravity: 1.0 g/cm$^3$) in place of calcined kaolin used for the formation of intermediate layer.

COMPARATIVE EXAMPLE 4

To a wood-free paper weighing 50 g/m$^2$ was applied only styrene-butadiene copolymer latex (Tg of styrene-butadiene copolymer: −35° C., solids content: 45%) in an amount of 15 g/cm$^2$ (thickness: 13 μm) on dry basis and dried to provide an intermediate layer. The same heat-sensitive layer as that provided in Example 1 was formed on this intermediate layer in the same manner as in Example 1 to prepare a heat-sensitive recording paper.

COMPARATIVE EXAMPLE 5

| | |
|---|---|
| Calcined kaolin (tradename: "ANSILEX", product of Engelhard, apparent specific gravity: 0.22 g/cm$^3$) | 100 parts |

-continued

| | |
|---|---|
| Styrene-butadiene copolymer latex (Tg of styrene-butadiene copolymer: +5° C., solids content: 48%) | 25 parts |
| 10% Aqueous solution of polyvinyl alcohol | 15 parts |
| Water | 100 parts |

The above components were mixed together to prepare intermediate layer coating composition-III.

A heat-sensitive recording paper comprising a double-layered intermediate layer was prepared in the same manner as in Example 11 with the exception of using intermediate layer coating composition-III in place of intermediate layer coating composition-I.

The 18 kinds of heat-sensitive recording papers thus obtained were subjected to recording using a thermal printer (Sony UP-701 Video Printer) with printing pulse of 3 ms or 8 ms. The image density of the record thus obtained was determined by Macbeth densitometer (RD-100R, using amber filter), and the results were shown in Table 1 below. Reproducibility o record picture element, cutting suitability, folding suitability and prevention of piling of residual matter were evaluated in the following manner and the results are shown in Table 1.

The reproducibility of record picture element was evaluated based on the dot-reproducibility (ratio of the area of record image to the area of one dot of the thermal head), according to the following criteria:

A: 86% or more

B: 76–85%

C: 70–75%

D: 69% or less

The cutting suitability was evaluated based on the degree of generation of paper dust caused by cutting the recording paper ten times with a cutter into eleven pieces of strips. Also the cut ends of the strips were examined through a magnifier (about 10×) if the heat-sensitive recording layer was separated. Evaluation was based on the following criteria.

A: Paper dust wa not generated and the heat sensitive recording layer was free of separation.

B: Paper dust was not practically generated but the heat sensitive recording layer was slightly separated.

D: Paper dust was markedly generated and the heat-sensitive recording layer was markedly separated.

The folding suitability was evaluated as follows. First, the heat-sensitive recording paper was subjected to recording over the entire surface with the thermal printer. Then the recording paper was folded with the recording layer inside and then unfolded. Subsequently, the folded portion of the recording paper was checked with the unaided eye for the separation of the heat-sensitive recording layer. Evaluation was based on the following criteria:

A: The heat-sensitive recording layer was free of separation.

B: The heat-sensitive recording layer was slightly separated.

C: The heat-sensitive recording layer was separated to some extent but usable without practical problem.

D: The heat-sensitive recording layer was markedly separated and cannot be put into practical use.

The prevention of piling of residual matter was evaluated by observing the presence of residual matter piled up on the thermal head after consecutive recording of 10 sheets of A4 size recording charts (printing rate of 50%). The criteria were as follows:

A: No residual matter was observed on the head.

B: Residual matter was slightly observed on the head but three was no practical problem.

D: Residual matter was markedly observed.

TABLE 1

| | 3 ms | | 8 ms | | Cutting | Folding | Prevention of |
|---|---|---|---|---|---|---|---|
| Example | Image density | Reproducibility | Image density | Reproducibility | suitability | suitability | piling of residual matter |
| Example 1 | 0.70 | A | 1.35 | A | A | A | A |
| Example 2 | 0.85 | A | 1.40 | A | A | A | A |
| Example 3 | 0.68 | A | 1.32 | A | A | A | A |
| Example 4(a) | 0.75 | A | 1.40 | A | A | A | A |
| Example 4(b) | 0.65 | A | 1.28 | A | A | A | A |
| Example 5 | 0.60 | B | 1.24 | A | A | A | A |
| Example 6 | 0.92 | A | 1.42 | A | A | A | A |
| Example 7 | 0.45 | C | 1.28 | B | A | A | A |
| Example 8 | 0.42 | B | 1.22 | B | A | A | B |
| Example 9 | 0.55 | B | 1.28 | B | B | C | A |
| Example 10 | 0.60 | B | 1.24 | A | B | B | A |
| Example 11 | 0.88 | A | 1.45 | A | A | A | A |
| Example 12 | 0.95 | A | 1.46 | A | A | A | A |
| Example 13 | 0.85 | A | 1.40 | A | A | A | A |
| Example 14 | 0.80 | A | 1.36 | A | A | A | A |
| Comparative Example 1 | 0.61 | D | 1.21 | B | D | D | A |
| Comparative Example 2 | 0.42 | D | 1.20 | C | D | D | A |
| Comparative Example 3 | 0.28 | C | 1.10 | C | A | A | D |
| Comparative Example 4 | 0.10 | C | 0.90 | C | A | A | D |
| Comparative Example 5 | 0.70 | D | 1.30 | B | B | D | A |

Table 1 shows that the heat-sensitive recording material of the present invention is excellent in reproducibility of record picture element irrespective of the image density, and has cutting suitability and folding suitability as well, and prevents piling of residual matter on the thermal head.

We claim:

1. A heat-sensitive recording material comprising a support and a heat-sensitive recording layer, characterized in that an intermediate layer is formed between the support and the heat-sensitive recording layer wherein the intermediate layer comprises a pigment having an apparent specific gravity of about 0.7 g/cm$^3$ or less and a polymeric substance having a glass transition temperature of 0° C. or lower as a binder.

2. A heat-sensitive recording material as defined in claim 1 wherein the intermediate layer is formed by applying a coating composition comprising a pigment having an apparent specific gravity of about 0.7 g/cm$^3$ or less and, as a binder, an aqueous emulsion or latex of a polymeric substance having a glass transition temperature of 0° C. or lower to the support and drying the resulting coating.

3. A heat-sensitive recording material as defined in claim 2 wherein the pigment and the aqueous emulsion or latex of the polymeric substance are used in a weight ratio of between 100:5 and 100:40 calculated as solids.

4. A heat-sensitive recording material as defined in claim 2 wherein the pigment and the aqueous emulsion or latex of the polymeric substance are used in a weight ratio of between 100:8 and 100:30 calculated as solids.

5. A heat-sensitive recording material as defined in claim 1 wherein the polymeric substance used as a binder has a glass transition temperature of −20° C. or lower.

6. A heat-sensitive recording material as defined in claim 1 wherein the intermediate layer comprises two or more layers, each of which contains said pigment and said polymeric substance.

7. A heat-sensitive recording material as defined in claim 1 wherein the intermediate layer has a two- to five-layered structure and an overall thickness of about 8 to about 40 μm, each of the layers comprising the intermediate layer containing said pigment and said polymeric substance and having a thickness of about 1 to about 20 μm.

8. A heat-sensitive recording material as defined in claim 1 wherein the intermediate layer has a double-layered or triple-layered structure and an overall thickness of about 8 to about 40 μm, each of the layers comprising the intermediate layer containing said pigment and said polymeric substance and having a thickness of about 1 to about 20 μm.

9. A heat-sensitive recording material as defined in claim 1 wherein the intermediate layer has a single-layered structure and has a thickness of about 5 to about 20 μm.

10. A heat-sensitive recording material as defined in claim 1 wherein the polymeric substance used as a binder is one member selected from the group consisting of natural rubber, polydienes, polyalkenes, styrene-acrylic acid copolymers, styrene-butadiene copolymers and acrylonitrile-butadiene copolymers.

11. A heat-sensitive recording material as defined in claim 1 wherein the polymeric substance used as a binder is one member selected from the group consisting of natural rubber, polyisoprenes and styrene-butadiene copolymers.

12. A heat-sensitive recording material as defined in claim 1 wherein the polymeric substance used as a binder is a styrene-butadiene copolymer.

13. A heat-sensitive recording material as defined in claim 1 wherein the pigment has an apparent specific gravity of about 0.1 to about 0.7 g/cm$^3$.

14. A heat-sensitive recording material as defined in claim 1 wherein the pigment has an apparent specific gravity of about 0.1 to about 0.3 g/cm$^3$.

15. A heat-sensitive recording material as defined in claim 1 wherein the pigment is at least one member selected from the group consisting of calcined kaolin, talc, precipitated calcium carbonate, amorphous silica, polystyrene fine powder and urea-formalin resin fine powder.

16. A heat-sensitive recording material as defined in claim 1 wherein the pigment is at least one member selected from the group consisting of calcined kaolin and amorphous silica.

* * * * *